US007452150B2

(12) United States Patent
Chan

(10) Patent No.: US 7,452,150 B2
(45) Date of Patent: Nov. 18, 2008

(54) ITEMS, SUCH AS WRITING IMPLEMENTS, WITH MOVABLE HOUSING

(75) Inventor: Sik Leung Chan, Tsuen Wan (HK)

(73) Assignee: C.C. & L Company Limited, Tsuen Wan, N.T. (HK)

( * ) Notice: Subject to any disclaimer, the term of this patent is extended or adjusted under 35 U.S.C. 154(b) by 487 days.

(21) Appl. No.: 11/208,986

(22) Filed: Aug. 22, 2005

(65) Prior Publication Data

US 2006/0228156 A1 Oct. 12, 2006

Related U.S. Application Data

(63) Continuation-in-part of application No. 29/227,396, filed on Apr. 11, 2005, now Pat. No. Des. 534,212.

(51) Int. Cl.
*B43K 7/12* (2006.01)
*B25G 1/01* (2006.01)

(52) U.S. Cl. ..... 401/117; 401/108; 81/489; 81/491

(58) Field of Classification Search ..... 401/107, 401/131, 99, 108, 117, 195; 368/316; 81/489, 81/490, 491; 16/408, 409, 410; 30/153–155, 30/159

See application file for complete search history.

(56) References Cited

U.S. PATENT DOCUMENTS

| | | | | |
|---|---|---|---|---|
| 889,436 | A | 6/1908 | Bustanoby | |
| 2,896,576 | A * | 7/1959 | Baer | 401/195 |
| 3,444,685 | A | 5/1969 | Juillerat | |
| 3,618,518 | A | 11/1971 | Rigoni | |
| 4,081,217 | A | 3/1978 | Klaber | |
| 4,149,812 | A | 4/1979 | Huffman, Jr. | |
| 4,549,827 | A | 10/1985 | Mack | |
| 4,804,286 | A | 2/1989 | Jarrett et al. | |
| 5,061,104 | A | 10/1991 | Florjancic | |
| 5,531,318 | A | 7/1996 | Coleman et al. | |
| 5,568,452 | A | 10/1996 | Kronenberg | |
| 6,120,816 | A | 9/2000 | Chan | |
| D436,868 | S | 1/2001 | Chan | |
| 6,178,085 | B1 | 1/2001 | Leung | |
| 6,273,627 | B1 | 8/2001 | Mittersinker et al. | |
| 6,464,419 | B1 | 10/2002 | Chan | |
| 6,804,170 | B1 | 10/2004 | Chan | |
| D498,259 | S | 11/2004 | Kung | |
| 2001/0045369 | A1 | 11/2001 | Pearlman et al. | |
| 2003/0010664 | A1 | 1/2003 | Bellin et al. | |
| 2003/0068186 | A1 | 4/2003 | Sorensen | |
| 2003/0152412 | A1 | 8/2003 | Rosso | |
| 2004/0109719 | A1 | 6/2004 | Rosso | |
| 2004/0221866 | A1 | 11/2004 | Greenfiled | |

* cited by examiner

*Primary Examiner*—David J Walczak
(74) *Attorney, Agent, or Firm*—Daniel P. Burke & Associates, PLLC

(57) ABSTRACT

Items such as writing implements comprise a housing which moves from a first configuration wherein a writing portion is at least partially disposed within a housing to a second configuration wherein more of the writing portion is disposed outside of the housing. In one version, upon the selective actuation of a release, at least two housing portions initially move away from each other while the writing portion moves from the first configuration toward the second configuration, the housing portions then move back toward each other, all in a damped motion. In the second configuration, at least a portion of the writing portion is further away from the hinge-type connection than in the first configuration.

48 Claims, 16 Drawing Sheets

ITEMS, SUCH AS WRITING IMPLEMENTS, WITH MOVABLE HOUSING

RELATED APPLICATION DATA

This application is a continuation-in-part of U.S. design application Ser. No. 29/227,396, filed Apr. 11, 2005 now U.S. Pat. No. DES,534,212.

The present invention is directed to items, such as writing implements comprising a writing portion originally disposed at least partially within a housing which, upon actuation of a release, opens and then closes while the writing portion is moved in a damped motion to a position which is more outside of said housing than the original position.

BACKGROUND

Various writing implements have been known wherein it is desirable for functional and/or aesthetic reasons to provide a housing for a writing tip. For example, it is not uncommon for a ball point pen to be provided in a clickable handle. Traditionally, such handles are provided to minimize leakage of ink when the pen is not in use. Other writing implements have been disclosed wherein manual manipulation moves a tip of a writing implement to a position where it is uncovered by the handle portion.

There is a desire for devices with novel movement, such as novelty items or promotional items. It would be particularly desirable to have a plurality of types of movement in a single device comprising at least one writing implement. It is also desirable to provide other items with housings and novel types of movement.

SUMMARY OF THE INVENTION

Some illustrated embodiments of the present invention are directed to writing implements comprising multi-piece housings. The writing implements of the present invention automatically move from a first configuration wherein a writing portion is at least partially disposed within a housing to a second configuration wherein more of the writing portion is disposed outside of the housing. The housing of certain embodiments comprises at least two portions which are connected with a hinge-type connection. Upon the selective actuation of a release, at least sections of two housing portions initially move away from each other while the writing portion moves from the first configuration toward the second configuration. The housing portions then move back toward each other, all in a damped motion. In the second configuration, at least a portion of the writing portion is preferably further away from the hinge-type connection than in the first configuration.

These illustrated embodiments utilize a driving mechanism comprising a spring for urging each connector which are each connected to a housing portion and the writing portion. The disclosed driving mechanism also comprises closely spaced surfaces and damping grease for dampening the spring biased movement of the connector. Upon activation of a release, the driving mechanisms move the connectors which effects the disclosed, damped movement of the housing portions. Other embodiments effect the desired movement with one or a greater number of driving mechanisms and housing portions.

For example, another embodiment of the present invention comprises an item, such as a writing implement or a flashlight, movably connected to a shield. The item is movable from a first position wherein a first portion of the item is in overlapping relation with the shield and a second position wherein the first portion of the item is not in overlapping relation with the shield. This illustrated embodiment comprises a connector which is pivotally connected to both the item and the shield. This embodiment also comprises means for moving the connector thereby causing relative movement between the item and the shield, and a dampening mechanism for dampening the movement of the connector and, consequently, slowing the relative movement of the item and shield.

DETAILED DESCRIPTION

Several embodiments of the present invention are directed to writing implements comprising at least one writing portion disposed within a multi-part housing. The writing implements of the present invention are provided with a drive mechanism which, upon the activation of a release, causes portions of the housing which are hingedly connected to each other to initially move away from each other while the writing portion is moved from a first position at least partially within the housing toward a position more outside the housing. The housing portions are initially moved away from each other and then are caused to move back toward each other as the writing portion is extended more outwardly of the housing. In the illustrated embodiments, as the writing portion is extended it is moved further away from the hinge connection of the housing portions. While these illustrated embodiments each comprise two housing portions and two driving mechanisms, it is within the scope of the present invention to use a greater number of housing portions, a single housing or shield, a single driving mechanism or a greater number of driving mechanisms.

Figure 1:
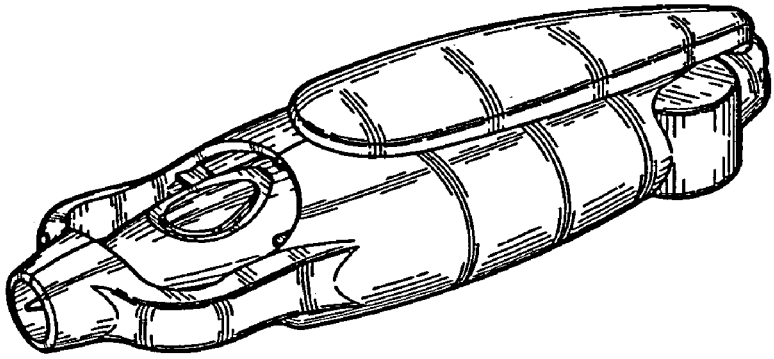
FIG. 1 is a perspective view of one embodiment of the present invention in the closed position.
Figure 2:
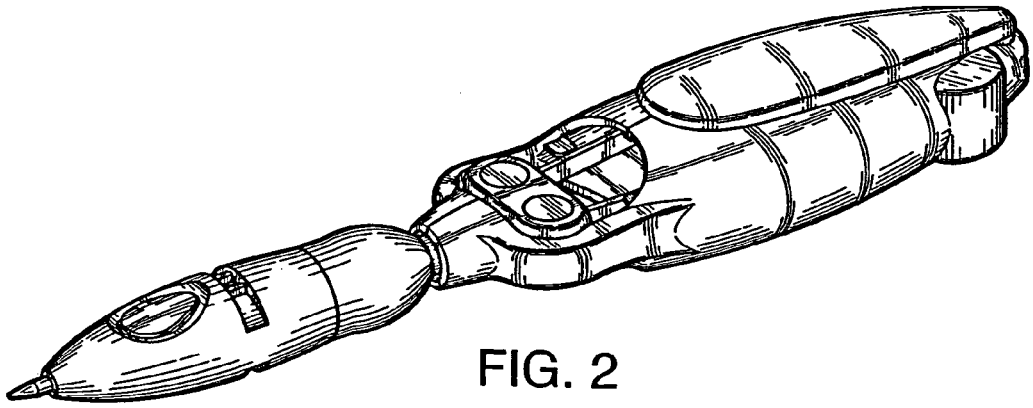
FIG. 2 is a perspective view of the writing implement of FIG. 1 fully opened.
Figure 4:
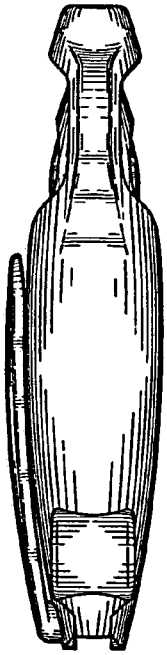
FIG. 4 is a side elevational view of the writing implement of FIG. 1 in the closed position.
Figure 3:
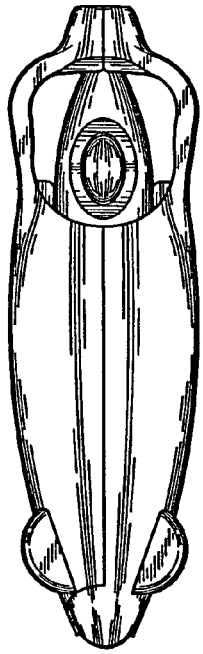
FIG. 3 is a bottom view of the writing implement of FIG. 1 in the closed position.
Figure 5:
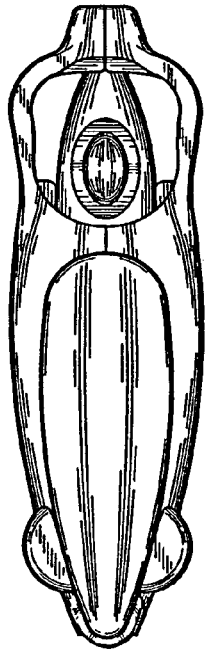
FIG. 5 is a top plan view of the writing implement of FIG. 1 in the closed position.
Figure 6:
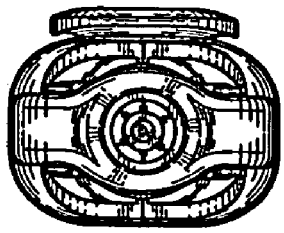
FIG. 6 is a first end view of the writing implement of FIG. 1 in the closed position.
Figure 7:
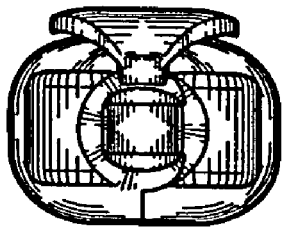
FIG. 7 is a second end view of the writing implement of FIG. 1 in the closed position.
Figure 8:
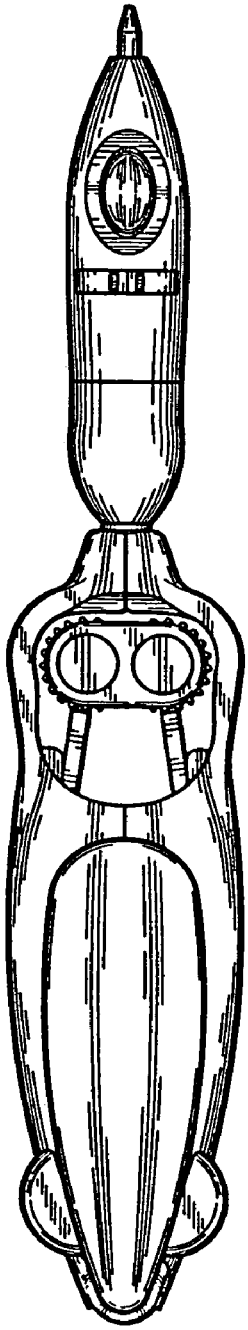
FIG. 8 is a top plan view of the writing implement of FIG. 1 fully opened.
Figure 9:
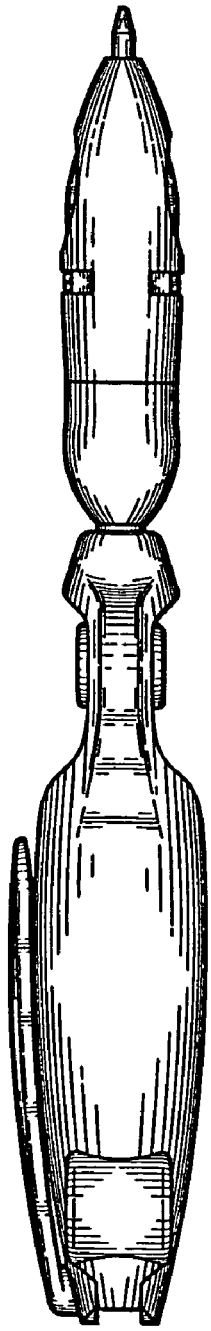
FIG. 9 is a side elevational view of the writing implement of FIG. 1 fully opened.
Figure 10:
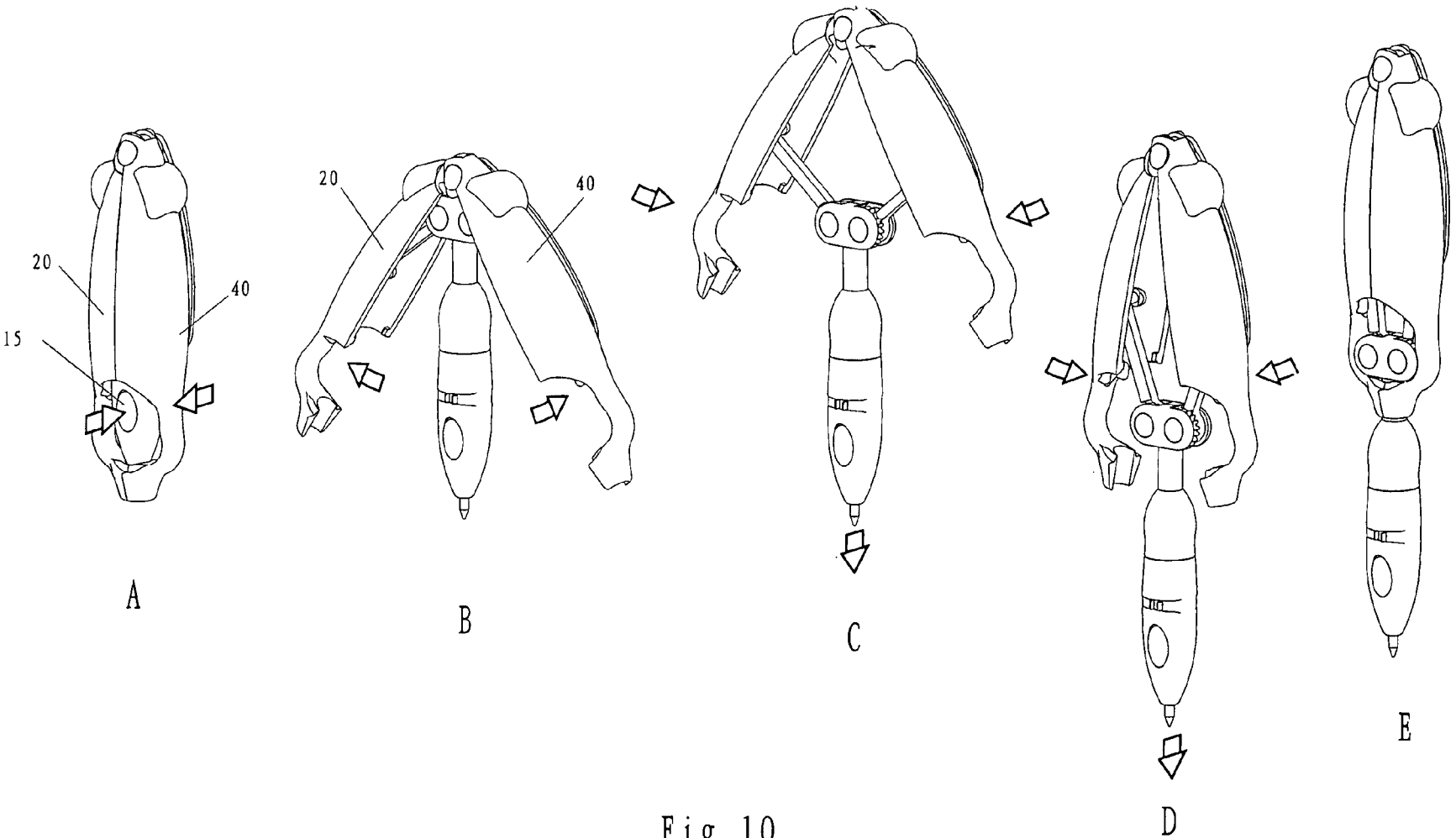
FIG. 10A-E illustrate the operation of the writing implement shown in FIG. 1.
Figure 12:
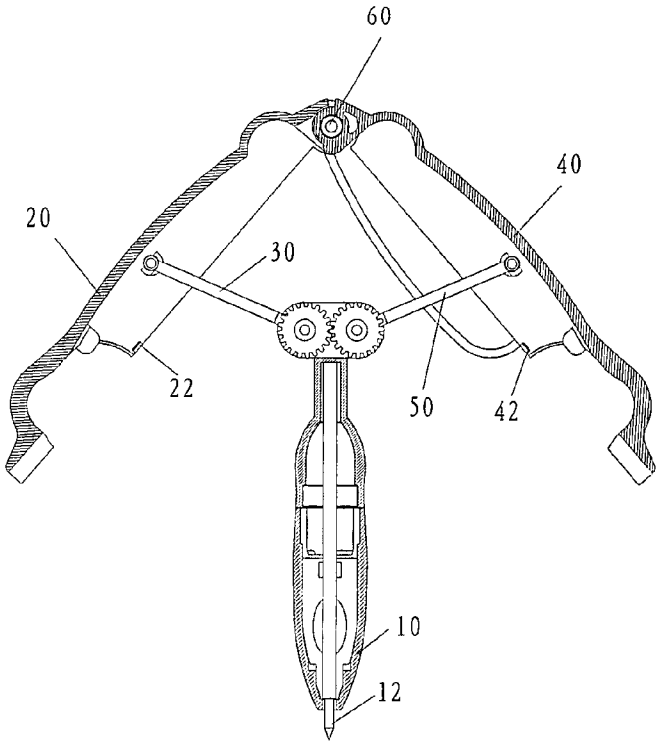
FIG. 12 is a cross-sectional view of the embodiment of FIG. 1 partially opened.
Figure 11:
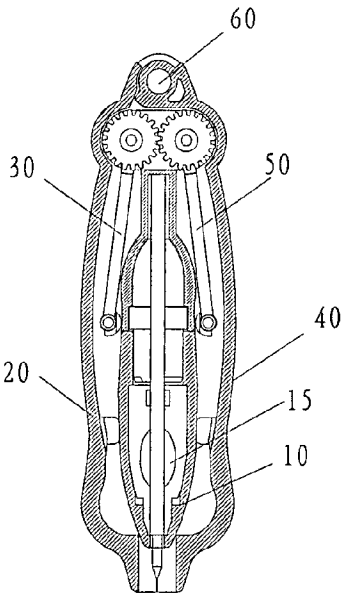
FIG. 11 is a cross-sectional view of one embodiment of the present invention in a closed configuration.
Figure 14:
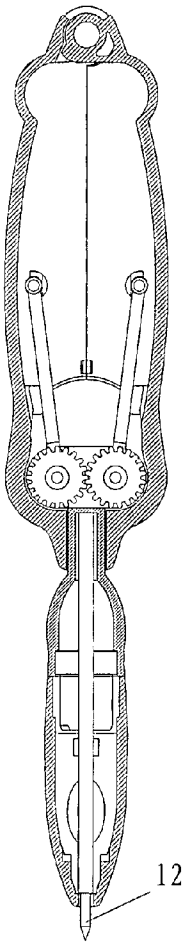
FIG. 14 is a cross-sectional view of the embodiment of FIG. 1 in the fully extended position.
Figure 13:
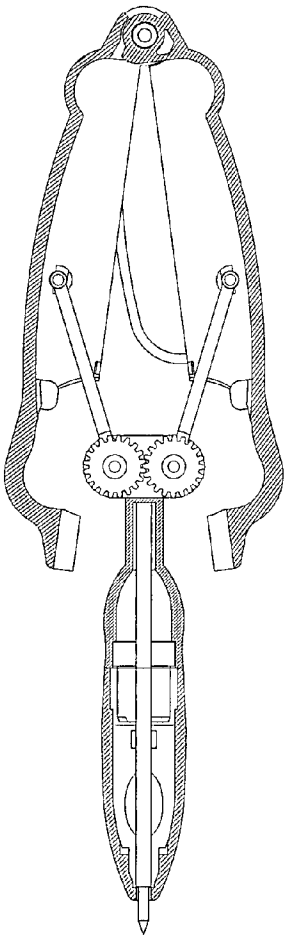
FIG. 13 is another cross-sectional view of the embodiment of FIG. 1 further opened.

FIGS. 1 through 15 illustrate one embodiment of the present invention in the form of a pen. FIGS. 1-9 are external views of this embodiment. FIGS. 10A-E illustrate the opening of the device of this embodiment of the present invention while FIGS. 11-14 are cross-sectional views showing the connection between the writing portion 10, first housing portion 20, via connector 30 and second housing 40, via connector 50. In this particular embodiment, the writing portion 10 is intended to be extended outwardly. The illustrated housing portions are hingedly connected proximate one end with hinge connector 60. The writing portion is in a closed or storage position in FIG. 11. This view illustrates first housing portion 20, second housing portion 40, writing portion 10 and release button 15. When release button 15 is depressed, latches 22 and 42 of housing portions 20, 40, respectively, are released and movement begins. Upon the release of the latches, the drive mechanisms move the connectors in a manner which spreads the illustrated housing portions 20, 40 and extends the writing portion outwardly as shown in FIGS. 12 and 13. With reference to FIGS. 11 and 12, connector 30 is moved clockwise in a controlled, damped motion causing the bottom portion of housing portion 20 to move outwardly and the entire housing portion 20 to be moved relative to writing tip 12. In the Figures, housing portion 20 is moved upwardly relative to writing portion 10. The corresponding driving motion imparted to housing portion 40 through connector 50 and the hinge connection 60 between the housing portions results in the desired substantial closure of the housing portions as shown in FIGS. 13 and 14. During operation, hinge connector 60, works cooperatively with pivotal hinge pins 15 shown in FIG. 15 and permit housing portions 20 and 40 to open in a generally pivotal manner and then close during the operation of the writing implement. While the housing portions can be said to move "upwardly" relative to the writing portion 10 in FIGS. 11-14, it will be appreciated that in actual use the direction of movement of the housing portions will depend upon the orientation of the writing implement during operation. From these drawings, it will be appreciated that as outward movement of the writing portion continues, the housing portions are moved back substantially together and the point 12 is usable as shown in FIG. 13.

Figure 15:
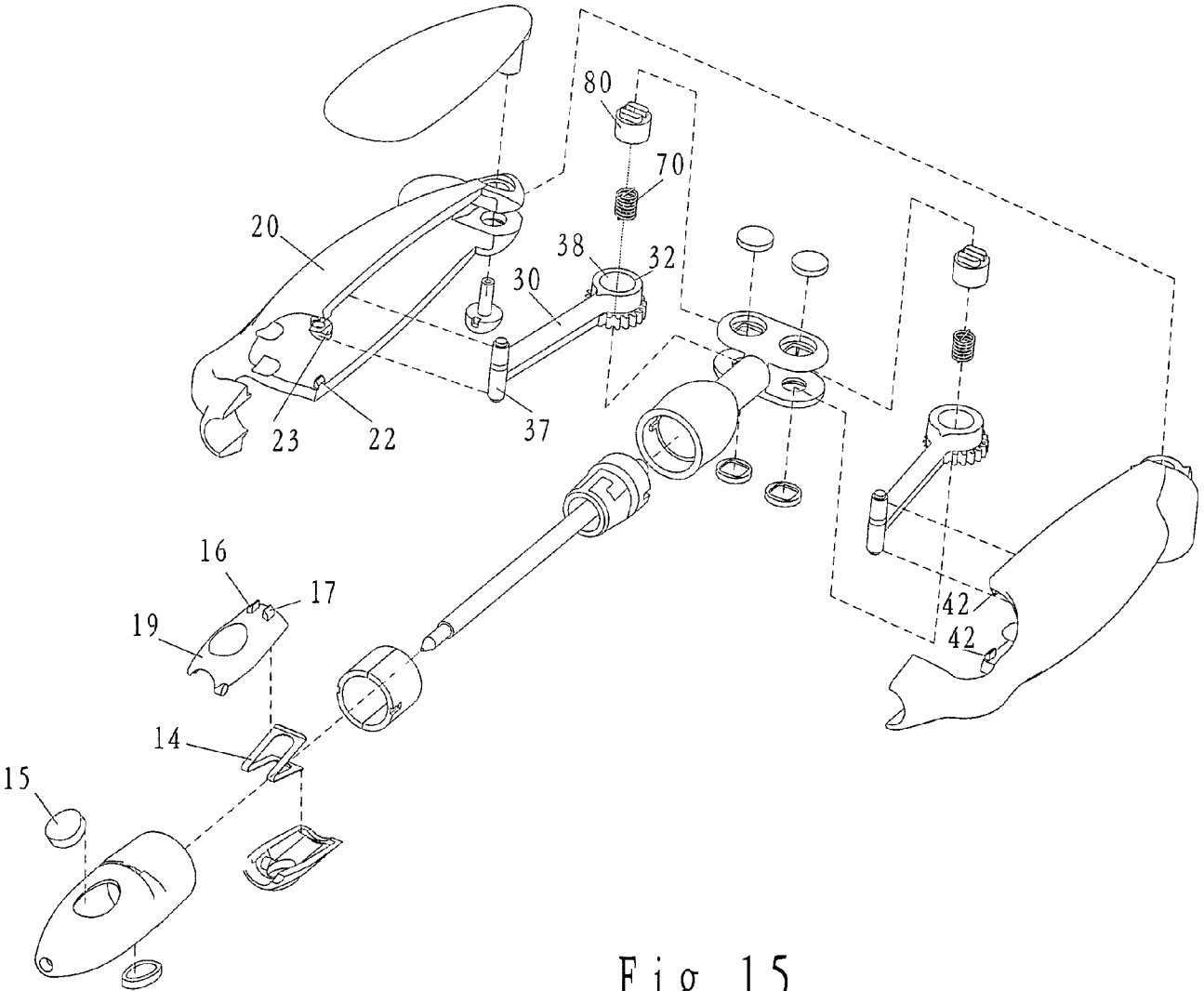
FIG. 15 is an exploded view of the embodiment of FIG. 1.

With reference to FIG. 15, connector 30 has an upper portion 32 and a lower portion 37. For purposes of this discussion, the words "upper" and "lower" refer to the connector 30 when the writing implement is in its initial closed or non-extended configuration and oriented as shown in FIGS. 11-14. The lower portion 37 of connector 30 comprises flanges 63 which are connected to any cooperate with corresponding flanges 23 on the interior surface of housing portion 20. These corresponding flanges are connected in order to provide a simple hinge connection between the lower portion of connector 30 and the interior surface of connector 20. The upper portion 32 of connector 30 comprises generally cylindrical recess 38 for receiving at least a portion of a drive mechanism and for connecting the upper portion 32 of connector 30 to the writing portion 10 of the pen.

With reference still to FIG. 15, the drive mechanism of this embodiment of the present invention comprises a coil spring 70 which is advantageously pre-wound to provide a desired torsional force. The coil spring is positioned internally between recess 38 of connector 30 and a cooperating, concentrically arranged barrel-shaped member, namely inner barrel 80. The illustrated coil spring 70 advantageously comprises a cross wire, extending radially at each end thereof. Each of these cross wires of torsional coil spring 70 engage a slot in the interior ends of the illustrated recess 38 and barrel member 80 when the barrel member is concentrically arranged within recess 38 during assembly. In this manner, each end of the spring will not move relative to the respective connector 30 and barrel member 80 to which it is attached. A damping grease such as a highly viscous oil or grease is disposed between the outer surface of the inner barrel 80 and the inner surface of recess 38. According to this illustrated embodiment, the barrel-shaped member 80 is fixed relative to the writing portion. The barrel 80 and recess 38 are relatively rotatable and will rotate relative to each other under the urging of coil spring 70. The arrangement of damping grease between the outer surface of inner barrel 80 and the inner surface of recess 38 will dampen the relative rotational movement of the connector and, therefore, result in a relatively slower rotational motion than would be provided in the absence of this damping arrangement. This illustrated embodiment comprises two driving mechanisms with one driving mechanism connected to each connector. It is also within the scope of the present invention to use fewer or a greater number of driving mechanisms and/or a different number of connectors. In this embodiment, a driving mechanism is connected to each of connector 30 and 50 which connect the writing portion to the two housing portions 20, 40. Other forms of driving mechanisms are also feasible within the scope of the present invention provided that they provide the desired driving force and a damped motion. For example, other types and positions of biasing members, such as other types of springs, can be utilized. It is also within the scope of the present invention to use other arrangements to dampen the movement of the item relative to the housing. It should be appreciated, however, that the illustrated embodiment is preferred for its simplicity and reasonable cost.

The operation of this embodiment of the present invention may best be understood from FIGS. 11-14 while the individual structural elements are shown in the exploded view of FIG. 15. In the initial unextended configuration shown in FIG. 11, the release button 15 is connected to a release member 19 which comprises forwardly and rearwardly extending latches 16 and 17 engages corresponding latches 22 and 42 on inner portions of housing portions 20 and 40, respectively. The preferred release button 15 comprises a forward, movable button with forwardly extending latches 16, 17 and a rearwardly facing button also comprising latches 16, 17. The forward and rearward button are biased outwardly by spring 14 which normally, in the absence of the pressing forces, maintains the latches in their forward most and rearward most positions. Thus, unless one of the buttons is depressed, the latches 16, 17 will engage latches 22, 42 of the housing portions 20, 40, respectively, to prevent unintended opening of the pen. Any type of biasing mechanism can be used for providing the normally forwardly and rearwardly directed forces on buttons 15, release members 19 and latches 16, 17. The preferred embodiment utilizes a leaf spring, though other urging means may also be utilized. In the configuration of FIG. 11, the release button 15 and latches 16, 17 are maintaining the housing portions 20 and 40 in the closed position against the urging force applied by the springs in the driving mechanisms. When a release button 15 is depressed, the housing members 20 and 40 are urged outwardly under the damped, driving force of the driving mechanism. As shown in FIGS. 11 and 12, connector 30 rotates in a generally clockwise direction relative to the writing portion causing housing portion 20 to open to the left while connector 50 is rotated in a counter-clockwise direction relative to the writing portion. In this embodiment, the rotation of the connectors relative to the drive mechanisms causes the writing portion to move outwardly relative to the housing portions.

As shown in FIGS. 12 and 13, after the connectors have passed a position of being generally perpendicular to the axis of the illustrated writing portion, the continued motion of the connectors causes the housing portions to be drawn closer together as the writing portion continues to be extended upwardly. FIG. 12 illustrates the fully extended position of this embodiment of the present invention wherein the housing portions are drawn back close to each other and the writing portion is substantially extended beyond the housing members. The point 12 of writing portion 10 is readily usable in this extended position.

From the present description, those skilled in the art will appreciate that the driving mechanisms can, not only take a different form, but can also be positioned in different places to affect the desired motion. For example, the driving mechanisms can be positioned on the housing side of the connectors rather than on the writing portion side of the connectors while affecting the same motion.

Figure 16:
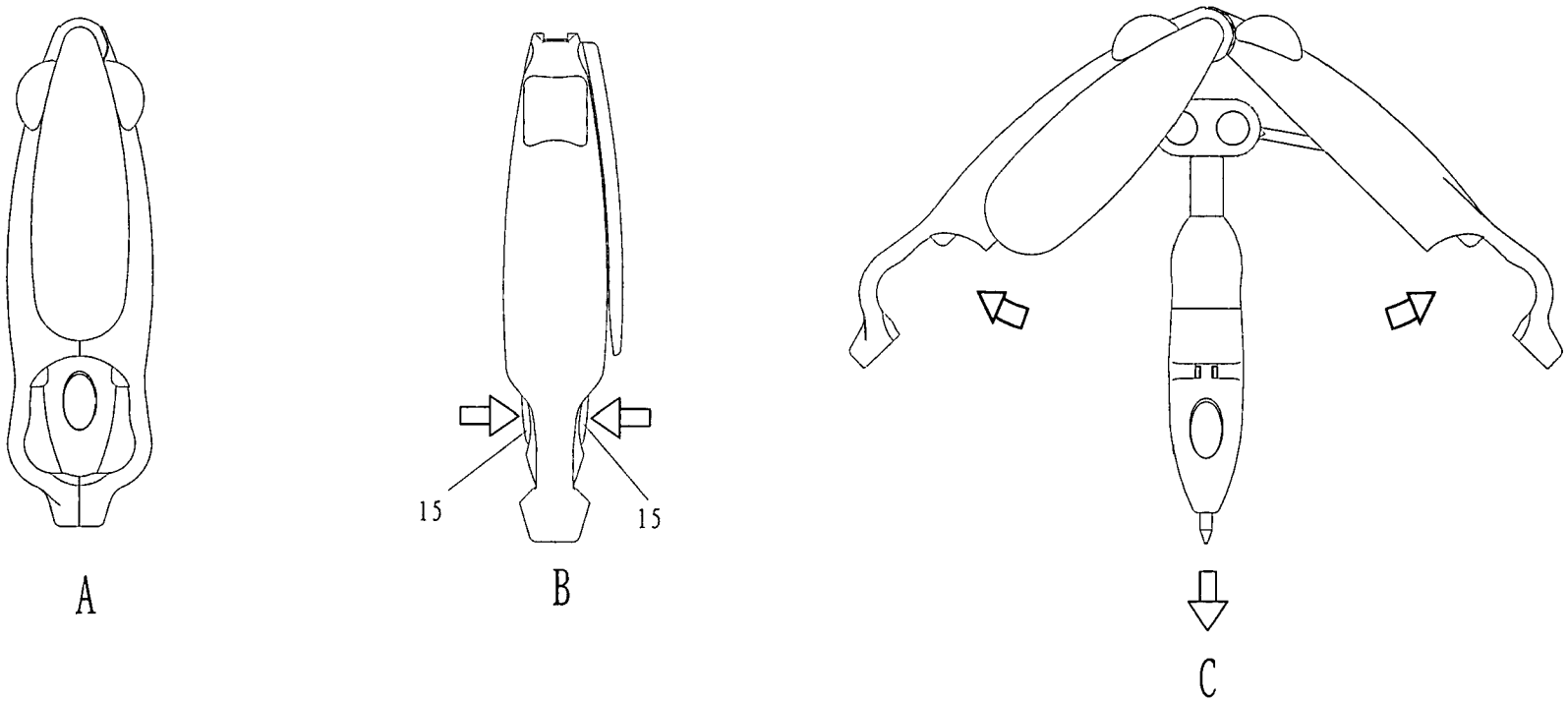
FIG. 16A-C illustrate the manner of utilizing the release of the embodiments shown in FIGS. 1-15.

FIGS. 16A-C illustrate the preferred manner of opening the embodiments shown in FIGS. 1-15. According to this illustrated embodiment, a user would typically grasp the writing implement between his thumb and forefinger and squeeze both buttons 15 inwardly in the direction of the arrows of FIG. 16B. Movement of button 15B cause movement of release members 19 which are disengaged from latches 22, 42 of the housing portions 20, 40, respectively. This results in the opening and relative movement of the housing portions relative to the writing portion as shown in FIG. 16C.

Figure 17E:
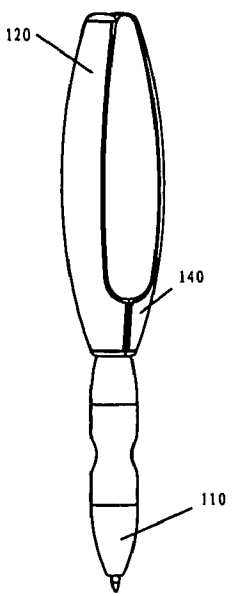
FIGS. 17A-E illustrate the operation of an alternative embodiment of the present invention.
Figure 17D:
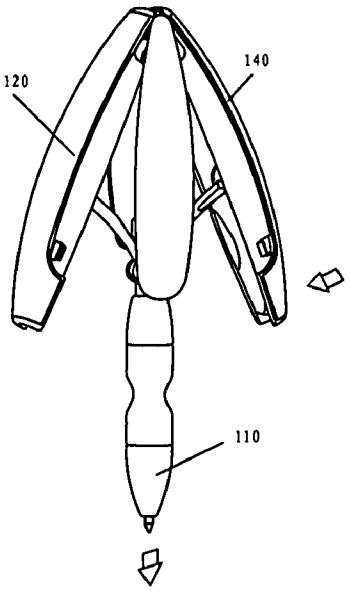
Figure 17C:
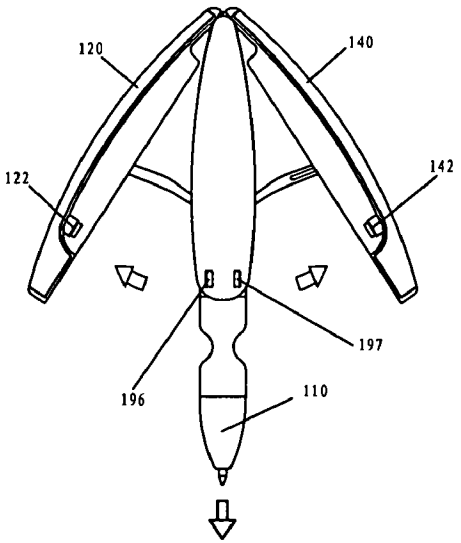
Figure 17B:
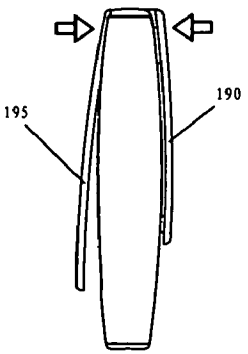
Figure 17A:
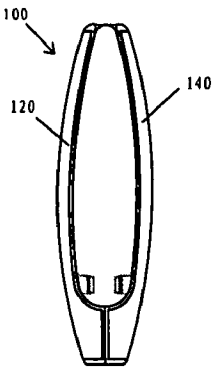
Figure 17F:
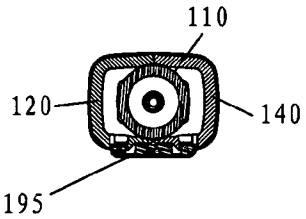
FIGS. 17F-H show front and cross-sectional views of the embodiment in FIGS. 17A-E.
Figure 17G:
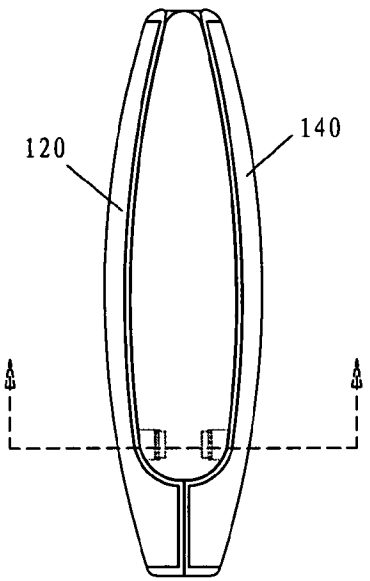

FIGS. 17A-E illustrate the opening of another preferred embodiment of the present invention. As illustrated in FIG. 17A, according to this embodiment of the present invention, the writing portion 110 is entirely enclosed within the housing of the writing implement 100 when the writing implement is in a closed configuration. This illustrated embodiment of the present invention comprises two housing portions 120, 140, a pocket clip 190 and a latch lever 195. This embodiment of the present invention does not comprise visible buttons but when the upper portion of pocket clip 190 and latch lever 195 are squeezed in the direction of the arrows shown in FIG. 17B, latches 196 and 197 on latch lever 195 (best shown in FIG. 22) are disengaged from latches 122 and 142 on housing portions 120, 140, respectively, (best shown in FIGS. 17C-D), and the writing implement begins to open as shown in FIG. 17C-E. FIG. 17B shows this embodiment after the device has been squeezed. As illustrated in FIGS. 17D and E, the continued movement of the housing portions 120 and 140 relative to the writing portion 110 is similar to the movement of the embodiment described above. Unlike the embodiment described above, however, the driving mechanisms of this preferred embodiment are positioned proximate the ends of the connectors 130, 150 which are connected to the housing portions 120, 140, respectively. FIGS. 17F, G and H show front and cross-sectional views of the latching portions of this embodiment.

Figure 22:
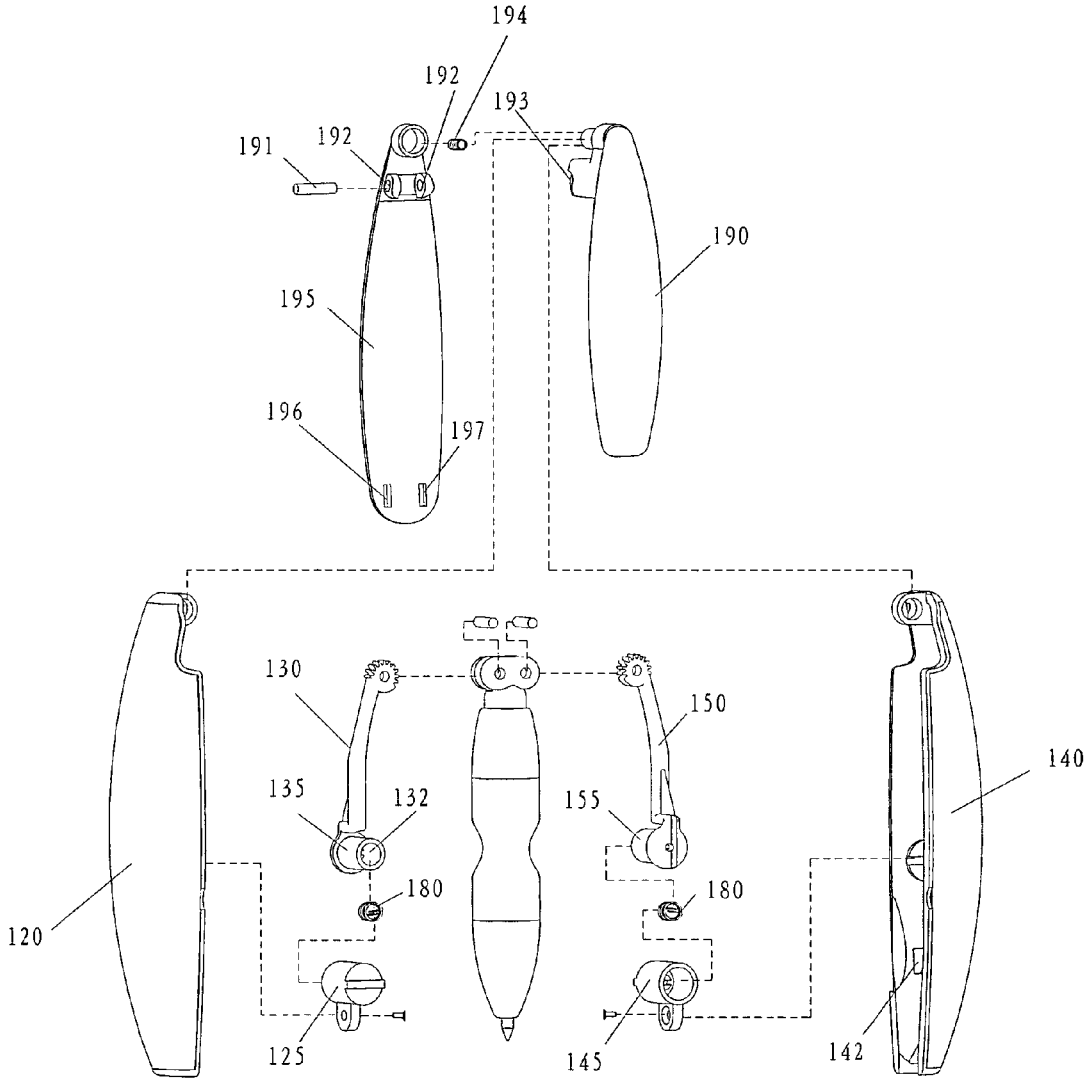
FIG. 22 is an exploded view of the embodiment sown in FIG. 17.
Figure 23:
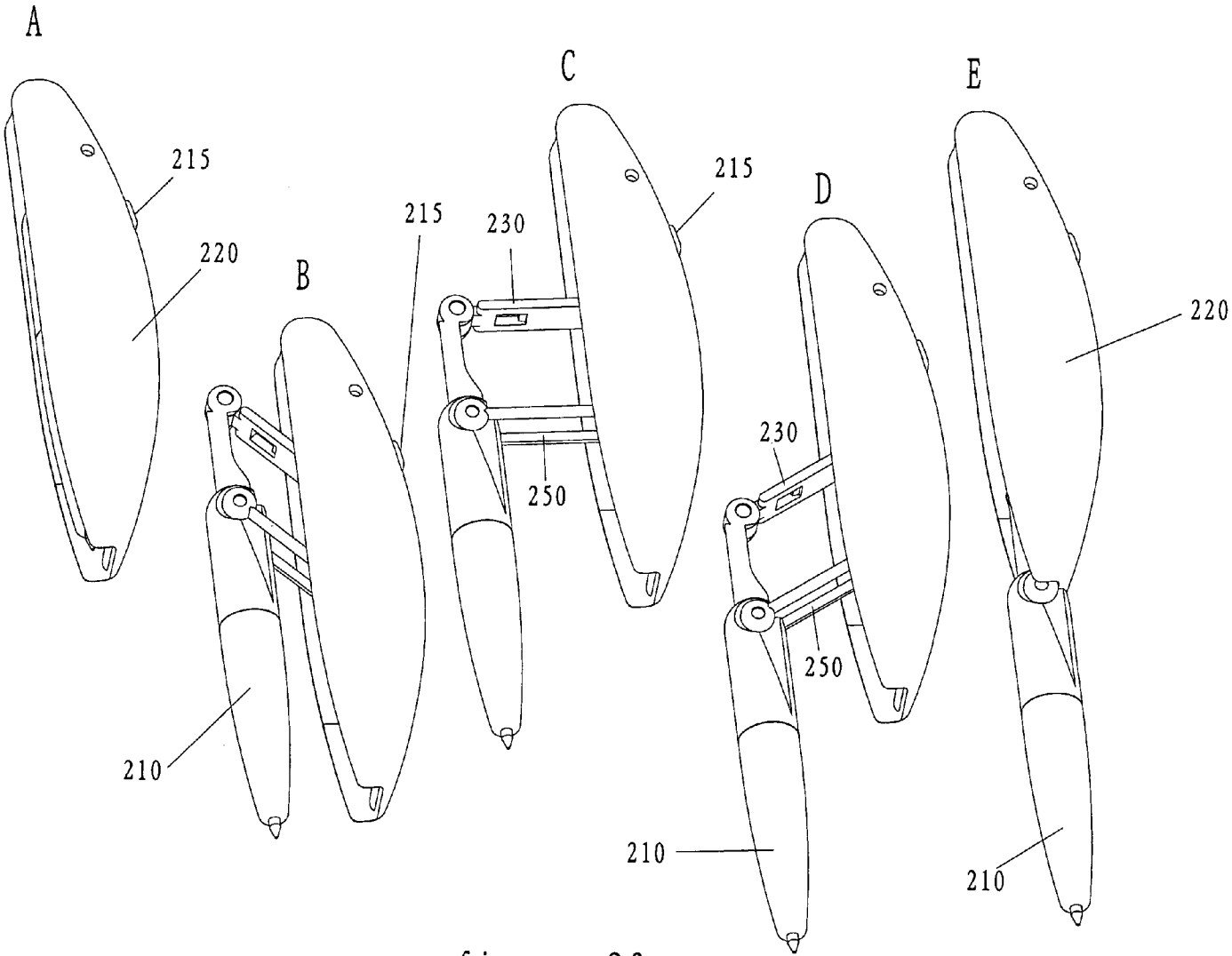
FIGS. 23*a-e* illustrate the operation of an alternative embodiment of the present invention.

With reference to FIG. 22, pocket clip 190 is pivotally connected to latch lever 195 with a hinge pin 191 which passes through flanges 192 and 193 of the latch lever 195 and pocket clip 190, respectively. The ends of pocket clip 190 and latch lever 195 which are intended to be squeezed together are normally separated by spring 194 which maintain these ends in a normally spaced arrangement. The interior surface of latch lever 195 comprise latches 196 and 197 on the interior surface opposite the hinge connection. When the ends of pocket clip 190 and latch lever 195 are squeezed together latches 196 and 197 will be displaced relative to the corresponding latches of 122, 142 of housing portions 120 and 140. This allows connecting members 130 and 150 to be driven by torsion springs 180 which are positioned within generally cylindrical cavities 132, 152 or barrel-shaped extensions 135, 155 on the connectors. The barrel-shaped extensions 135, 155 on the connectors are designed to rotate within generally barrel-shaped connectors 125, 145 which are connected to housing portions 120, 140, respectively. As with the embodiment described above, a viscous grease is disposed between the interior of the barrel-shaped attachment members 125, 145 and the exterior surfaces of barrel-shaped extensions 135, 155, respectively. In a manner similar to that described above, the driving mechanism comprising these springs 180 and the damping arrangement provided by the barrel-shaped extensions and barrel-shaped attachment members move the housing portions in the desired, damped manner during the opening of the illustrated end.

While these illustrated embodiments, of the present invention utilizes a two-piece housing, other embodiments of the present invention include single or different numbers of housing pieces and provide relative motion between an item and the housing in other directions, such as vertical and combinations of horizontal and vertical motions.

FIGS. 23A-E illustrate a further embodiment of the present invention comprising a pen 210, a shield 220, a spring biased latch release 215 and connectors 230, 250. According to this illustrated embodiment, in a first "closed" position, pen 210 is substantially shielded on the right side as well as from the front and rear when viewed from the perspective shown in FIG. 23A. Upon actuation of release button 215, connector 230 is released and a driving mechanism comprising a spring and dampening mechanism slowly drives connector 230 in the manner illustrated in FIG. 23B and then continues in the sequence illustrated by FIGS. 23C-E. Thus this embodiment utilizes a single "shield" which can cover substantially the entire item, in this case, pen 210 when this device is placed on a flat surface. As used herein, the term "shield" is intended to indicate that at least a portion of the item is covered when viewed from at least one angle. The item may be partially shielded from above, but the shield can also be positioned below, to a side, etc. The shield can also be translucent or transparent, so the word "viewed" is used to indicate a point of perspective rather than the ability to see the item from such a point. A "shield" therefore, would include, but not be limited to, a cover, a housing, a lid, and a partial cover, partial lid, and a partial housing.

Figure 24:
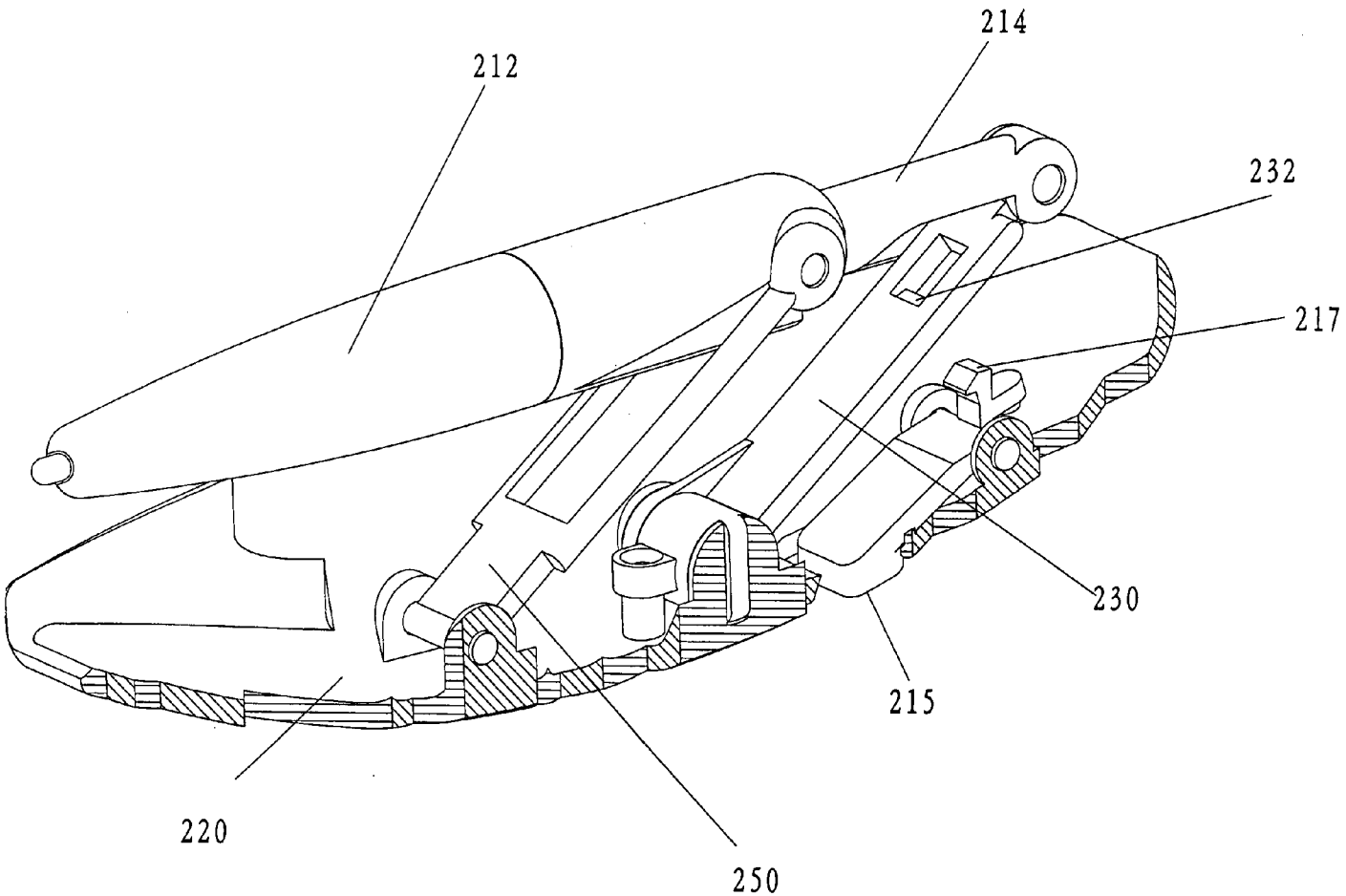
FIG. 24 is a partial cross-sectional view of an embodiment similar to the one illustrated in FIG. 23.

FIG. 24 is another version of this embodiment of the present invention, however, the item is a flashlight 212, rather than a pen 210. Otherwise, the embodiment illustrated in FIG. 24 is identical to the embodiment illustrated in FIGS. 23*a*-*e*. As best shown in FIG. 24, connector 230 comprises a slot 232 which is selectively engageable by a latch 217 connected to spring-biased release button 215. It is within the scope of the present invention for a latch to be selectively engageable with the item, such as the light or a writing implement, or some other structure which prevents movement of the item relative to the shield prior to the intended release of the latch. Connector 250 is simply pivotally connected to both the shield 220 and light 212. Connector 230, in this illustrated embodiment, is pivotally connected to shield 220 with a combined moving mechanism and dampening mechanism which are formed in a single driving mechanism. The other end of connector 230 is pivotally connected to an extension 214 of the light 212.

While several illustrated embodiments of the present invention are pens, the advantages of the present invention can be used with other writing implements such as mechanical pencils, felt markers, and pencils, as well as other items, such as flashlights.

I claim:

1. A writing implement comprising a multi-piece housing and writing portion movably connected to said housing, said writing portion movable between at least two configurations relative to said housing, including a first configuration wherein said writing portion is disposed at least partially within said housing and a second configuration wherein said writing portion is disposed more outside said housing than in said first configuration;

said housing comprising at least a first housing portion and a second housing portion hingedly connected to said first housing portion;

means for moving said first and second housing portions away from each other and then toward each other in a damped motion while moving said writing portion from said first configuration toward said second configuration.

2. A writing implement according to claim 1 wherein said portions of said housing which are hingedly connected are further from said writing portion in said second configuration than said first configuration.

3. A writing implement according to claim 1 wherein in said first configuration, said writing portion is substantially enclosed within said housing.

4. A writing implement according to claim 1 wherein in said first configuration, said writing portion is entirely enclosed within said housing.

5. A writing implement according to claim 1 wherein said moving means comprises:

at least one driving mechanism, and means for movably connecting said housing portions with said writing portion comprising:

at least one driving mechanism, and at least one connector for each of said movable housing portions for movably connecting said housing portions with said writing portion including:

a first connector having a first end portion and a second end portion, said first end portion pivotally connected to one of said writing portion and said first housing portion and said second end portion connected to said driving mechanism which is connected to the other of said writing portion and said first housing portion; and a second connector pivotally connected to said writing portion and pivotally connected to said second housing portion.

6. A writing implement according to claim 5 wherein said driving mechanism comprises at least one means for urging said first connector away from said writing portion and means for damping the movement of said first connector.

7. A writing implement according to claim 6 wherein said urging means comprises a spring.

8. A writing implement according to claim 7 wherein said spring is a coil spring.

9. A writing implement according to claim 6 wherein said damping means comprises two relatively movable, spaced surfaces with a viscous grease between said surfaces.

10. A writing implement according to claim 6 wherein said damping means comprises two, relatively movable, substantially cylindrical surfaces with a viscous grease between said surfaces.

11. A writing implement according to claim 5 comprising a second driving mechanism connected to said second connector.

12. A writing implement according to claim 5 wherein said second end portion of said first connector is connected to said writing portion.

13. A writing implement according to claim 12 wherein said writing implement comprises two driving mechanisms connected to said housing portions.

14. A writing implement according to claim 12 wherein said writing implement comprises two driving mechanisms connected to said writing portion.

15. A writing implement according to claim 5 wherein said second end portion of said first connector is connected to said first housing portion.

16. A writing implement according to claim 1 further comprising means for releasably engaging at least one portion of said housing for releasably securing said housing in said first configuration.

17. A writing implement according to claim 1 further comprising means for releasably engaging at least one portion of said housing for releasably securing said housing in said first configuration wherein said engaging means engages both of said housing portions.

18. A writing implement according to claim 1 further comprising means for releasably engaging at least one portion of said housing for releasably securing said housing in said first configuration wherein said engaging means comprises at least one spring biased release.

19. A writing implement according to claim 1 further comprising means for releasably engaging at least one portion of said housing for releasably securing said housing in said first configuration wherein said engaging means comprises a spring biased release for each of said housing portions.

20. A writing implement according to claim 1 further comprising means for releasably engaging at least one portion of said housing for releasably securing said housing in said first configuration wherein said engaging means comprises at least one button and a movable latch.

21. A device comprising:

an item;

a shield for at least a portion of said item;

at least one connector pivotally connected to said item and pivotally connected to said shield;

said item movable from a first position, wherein said shield is in overlapping relation with a first portion of said item, to a second position wherein said shield is not in overlapping relation with said first portion of said item;

means for moving said connector; and means for dampening the movement of said connector.

22. A device according to claim 21 wherein said shield covers all of said item.

23. A device according to claim 21 wherein said shield covers substantially all of said item.

24. A device according to claim 21 wherein said shield is longer than said item.

25. A device according to claim 21 wherein said shield overlaps said item in said first position.

26. A device according to claim 21 wherein said shield entirely overlaps said item in said first position.

27. A device according to claim 21 wherein said shield overlaps a major portion of said item in said first position.

28. A device according to claim 21 wherein said moving means and said dampening means are arranged concentrically.

29. A device according to claim 21 wherein said moving means and said dampening means are in a single component.

30. A device according to claim 21 wherein said moving means and said dampening means are arranged in spaced relation.

31. A device according to claim 21 comprising means for releasably securing said device in said first position.

32. A device according to claim 31 wherein said securing means comprises a movable latch.

33. A device according to claim 32 wherein said latch is spring biased.

34. A device according to claim 32 wherein said latch releasably engages at least one connector.

35. A device according to claim 21 wherein said device comprises at least two connectors.

36. A device according to claim 21 where said item comprises a writing implement.

37. A device according to claim 36 wherein said item comprises a pen.

38. A device according to claim 21 wherein said item comprises a light.

39. A device according to claim 21 wherein said item is a useful article.

40. A device comprising a multi-piece housing and a useful article movably connected to said housing, said useful article movable between at least two positions relative to said housing, including a first position wherein said useful article is disposed at least partially within said housing and a second position wherein said useful article is disposed more outside said housing than in said first position;

said housing comprising at least a first housing portion and a second housing portion hingedly connected to said first housing portion;

means for moving said first and second housing portions away from each other and then toward each other in a damped motion while moving said useful article from said first position to said second position.

41. A device according to claim 40 wherein said portions of said housing which are hingedly connected are further from said useful article in said second position than said first position.

42. A device according to claim 40 wherein when said useful article is in said first position, said useful article is substantially enclosed within said housing.

43. A device according to claim 40 wherein when said useful article is in said first position, said useful article is entirely enclosed within said housing.

44. A device according to claim 40 wherein said moving means comprises:

at least one driving mechanism, and means for movably connecting said housing portions with said useful article comprising:

at least one driving mechanism, and at least one connector for each of said movable housing portions for movably connecting said housing portions with said useful article including:

a first connector having a first end portion and a second end portion, said first end portion pivotally connected to one of said useful article and said first housing portion and said second end portion connected to said driving mechanism which is connected to the other of said useful article and said first housing portion; and a second connector pivotally connected to said useful article and pivotally connected to said second housing portion.

45. A device according to claim 44 wherein said driving mechanism comprises at least one means for urging said first connector away from said useful article and means for damping the movement of said first connector.

46. A device according to claim 45 wherein said urging means comprises a spring.

47. A device according to claim 40 wherein said useful article is a flash light.

48. A device according to claim 40 wherein said useful article is a writing implement.

* * * * *

UNITED STATES PATENT AND TRADEMARK OFFICE

CERTIFICATE OF CORRECTION

Figure 17H:
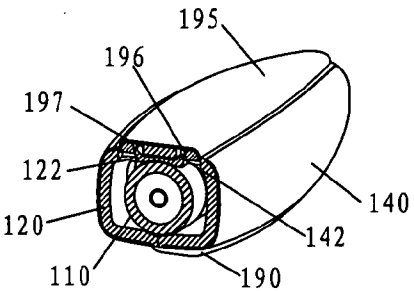
Figure 21:
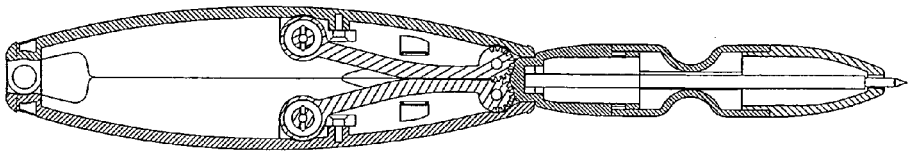
FIG. 21 is another cross-sectional view of the embodiment of FIG. 17 in the fully extended position.
Figure 20:
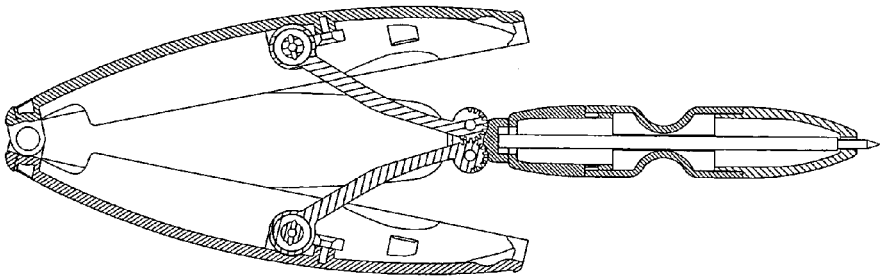
FIG. 20 is another cross-sectional view of the embodiment of FIG. 17 further opened.
Figure 19:
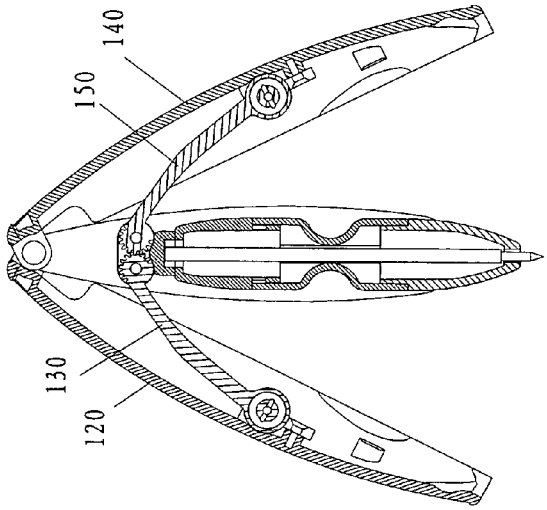
FIG. 19 is a cross-sectional view of the embodiment of FIG. 17 partially opened.
Figure 18:
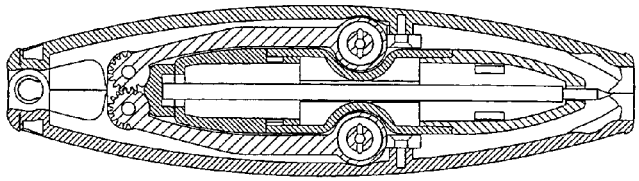
FIG. 18 is a cross-sectional view of the embodiment shown in FIG. 17.

PATENT NO. : 7,452,150 B2
APPLICATION NO. : 11/208986
DATED : November 18, 2008
INVENTOR(S) : Sik Leung Chan It is certified that error appears in the above-identified patent and that said Letters Patent is hereby corrected as shown below:

In the drawings, sheet 12, Fig. 17H, the reference numeral "196" should be --197--.

In the drawings, sheet 12, Fig. 17H, the reference numeral "197" should be --196--.

In the drawings, sheet 14, Fig. 22, the reference numeral "196" should be --197--.

In the drawings, sheet 14, Fig. 22, the reference numeral "197" should be --196--.

Signed and Sealed this

Tenth Day of February, 2009

John Doll

JOHN DOLL
*Acting Director of the United States Patent and Trademark Office*